United States Patent [19]

Fiedler

[11] 4,017,022

[45] Apr. 12, 1977

[54] CENTRIFUGE ARRANGEMENT AND METHOD OF MAKING A CONICAL CONTAINER THEREFOR

[75] Inventor: Bernhard Fiedler, Grevenbroich, Germany

[73] Assignee: Maschinenfabrik Buckau R. Wolf Aktiengesellschaft, Grevenbroich, Germany

[22] Filed: Oct. 17, 1975

[21] Appl. No.: 623,455

[30] Foreign Application Priority Data

Oct. 24, 1974 Germany ..... 2450552

[52] U.S. Cl. ..... 233/1 R; 233/2; 127/19

[51] Int. Cl.[2] ..... B04B 7/04

[58] Field of Search ..... 233/1 R, 2, 27, 28, 233/46, 1 E; 127/19

[56] References Cited

UNITED STATES PATENTS

| | | | |
|---|---|---|---|
| 2,695,133 | 11/1954 | Drury | 233/2 |
| 2,883,054 | 4/1959 | Sanchez | 233/1 E |
| 3,647,135 | 3/1972 | Mercier | 233/2 X |
| 3,837,913 | 9/1974 | Hillebrand | 127/19 |

FOREIGN PATENTS OR APPLICATIONS

| | | | |
|---|---|---|---|
| 1,482,717 | 11/1969 | Germany | 233/27 |

*Primary Examiner*—George H. Krizmanich
*Attorney, Agent, or Firm*—Michael J. Striker

[57] ABSTRACT

A centrifuge arrangement comprises a rotor mounted for rotation about an axis and a relatively thin-walled, onepiece, conically-shaped container having a circumferential wall and an upper and a lower portion integrally connected with the circumferential wall. The lower portion is adhesively secured to a rotor with a hardenable substance which cures over a period of time, thus permitting adjustment of the connection between the container and the rotor so that they rotate without causing undesirable vibrations. A rolling method of making the conically-shaped container is also disclosed.

8 Claims, 4 Drawing Figures

CENTRIFUGE ARRANGEMENT AND METHOD OF MAKING A CONICAL CONTAINER THEREFOR

BACKGROUND OF THE INVENTION

The present invention relates to a centrifuge arrangement and, more particularly, to a continuously-running centrifuge having a relatively thin-walled, one-piece, conically-shaped container which is relatively free of undesirable vibrations and which is further free of out-of-true rotation. The present invention further relates to a rolling method of making the conically-shaped container.

It is highly desirable to build a centrifuge arrangement so that it is, among other factors, vibration-free, lightweight, thin-walled, concentrically-running, inexpensive, and efficient in its use of energy. However, the prior art has had difficulties in providing centrifuges with these advantageous characteristics.

Thus, the prior art has proposed casting the container which receives and rotates the mixture to be separated into its constituent parts. However, casting techniques generally provide the container with an initial thickness of about 30 mm and a final machined thickness of between 12 mm and 15 mm.

The prior art has also proposed welding the containers out of separate metallic plates. These plates generally have an initial thickness of about 15 mm and a final machined thickness of between 8 and 10 mm.

In both of these aforementioned methods of making the container, there are several related problems. First of all, the container must always be subsequently machined in order to try and eliminate the unavoidable imbalances inherent in the container which will cause the container to rotate out-of-true. This machining is evidently very expensive. Secondly, because of structural rigidity reasons, the cast container must be maintained thicker than the welded container. However, on account of the subsequently required machining operation in both techniques, the containers cannot be made arbitrarily thin. Thus, both types of containers are still too relatively thick, even after the subsequent machining. The high weight of the containers requires an additional amount of energy input in order to rotate the container. Thirdly, the relatively heavy containers of the prior art have a further disadvantage in that intermittent feeding of the mixture into the container causes strong vibrations which vibrate the base of the centrifuge and tend to displace the entire housing of the arrangement.

It has further been proposed in the prior art to reduce the wall thickness of the container by a deep drawing operation. The containers made by this technique, however, have not been satisfactory, inasmuch as the male tool must repeatedly engage the female tool with different forces of engagement. Thus, the true-running characteristic of this type of container is impaired.

Finally, the prior art has also proposed various techniques for securing the container to a rotor of the centrifuge. These approaches have included welding, soldering and riveting both parts together. However, all of these techniques are disadvantageous because the tensions and strains introduced into the container itself will subsequently be released and distort the precise, true-running characteristic of the container. Even if the container is not subsequently machined, a pure screw-type connection disadvantageously influences the true-running characteristic of the container.

SUMMARY OF THE INVENTION

Accordingly, it is a general object of the present invention to overcome the disadvantages of the prior art.

More particularly, it is an object of the present invention to make a thin-walled, conically-shaped container for a centrifuge arrangement.

Another object of the present invention is to make a thin-walled, conically-shaped container for a centrifuge arrangement which does not require subsequent machining.

A further object of the present invention is to make a lightweight container for a centrifuge arrangement.

Yet an additional object of the present invention is to make a container which has a true-running characteristic.

Still a further object of the present invention is to make a container which is rugged, strong, compact, corrosion resistant and vibration-free.

An additional object of the present invention is to make a container which is economical in manufacture.

In keeping with these objects and with others which will become apparent hereinafter, one feature of the invention is embodied in a combination in a centrifuge arrangement which mounts a rotor in the centrifuge for rotation about an axis. A thin-walled, one-piece, conically-shaped container having a circumferential wall and a lower portion which includes a base portion integral with the circumferential wall is secured to the rotor so that the rotor and the container will rotate together and thereby cause components of a mixture admitted into the container to separate by centrifugal action.

Another feature of the invention is the making of the container itself. Instead of casting, welding or deep-drawing the container, the container is made of a one-piece construction by a so-called rolling or projecting operation which cold work hardens the container. The rolling operation, as will be described herein, stretches and shapes a blank and makes the blank very compact and dense so that the finished container has a doubled tensile strength characteristic. This feature of the invention permits the container to be thin-walled, to be of light weight, and not to require any subsequent machining.

Moreover, the above features assure a highly precise, true-running characteristic for the centrifuge arrangement. By rolling the container, weight imbalances are substantially eliminated for the container so that a relatively quiet and smooth running operation is now guaranteed as compared with prior art containers. Weight imbalances occur not only in the particular mode of construction of the container, but also in the feeding of the mixture into the container itself. Intermittent and unequal feeding are automatically balanced in the thin-wall container of the invention. If the filler material is deposited only on one side of the container, the thin walls thereof will deform and change to a steeper inclination angle. The greater inclination angle thereby causes the filler mixture to flow downwardly more rapidly, thus eliminating the source of the imbalance. The thin walls of the container are slightly resilient and return to their initial conical shape due to their own resilience. Another feature of the invention is the long lasting connection between the lower portion of the container and the rotor. A hardenable substance, such as a curable paste for metals, is preferably used. The paste takes time to cure so that the container can be repeatedly checked and repositioned for concentric turning. In order to improve the connection, grooves are provided on the rotor which are filled with adhesive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
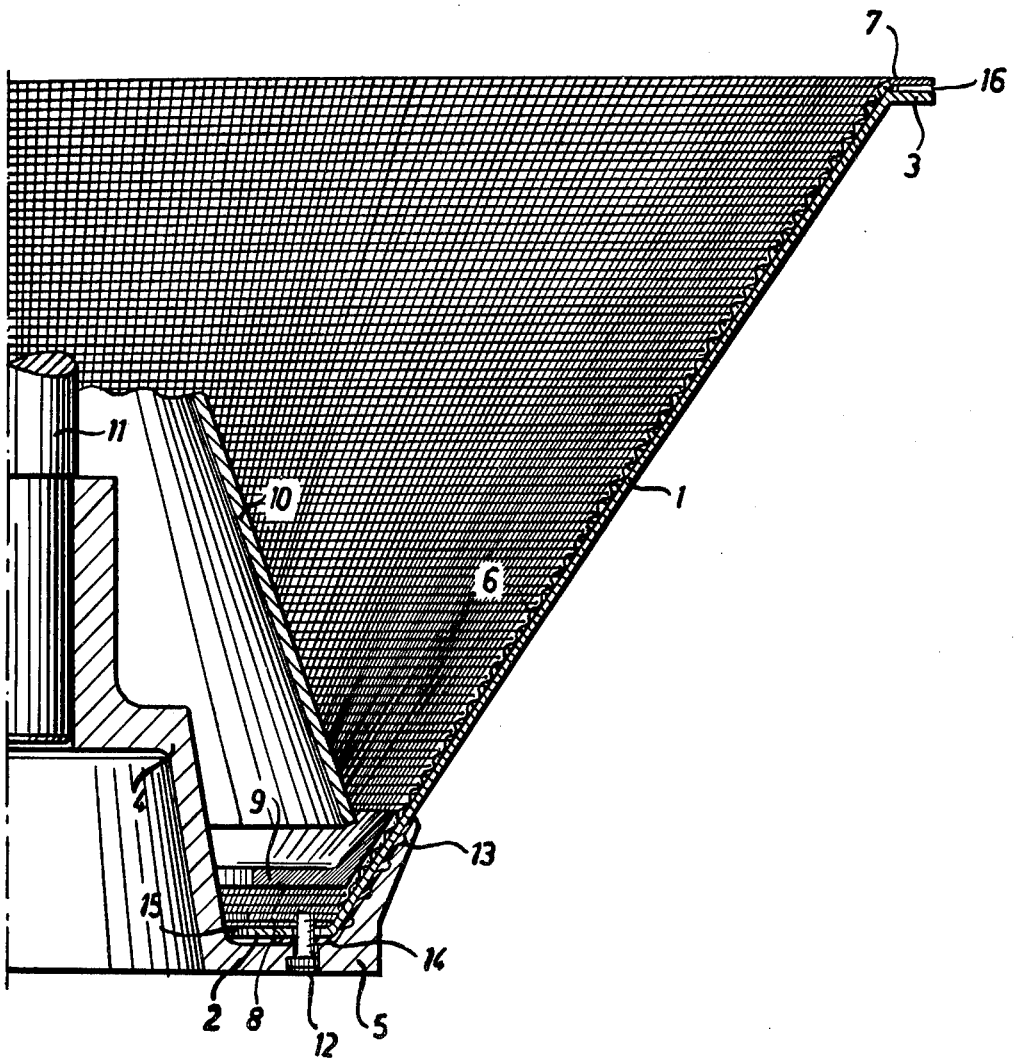
FIG. 1 is a partially broken, partially sectioned view of the centrifuge arrangement according to the present invention.

Referring to the centrifuge arrangement shown in FIG. 1, it will be seen that reference numeral 1 identifies a funnel or conically-shaped container which is connected to a rotor having a hub 4. A shaft 11 is received in a central bore of the rotor, and the rotor is driven about the shaft axis by nonillustrated conventional drive means.

Figure 2:
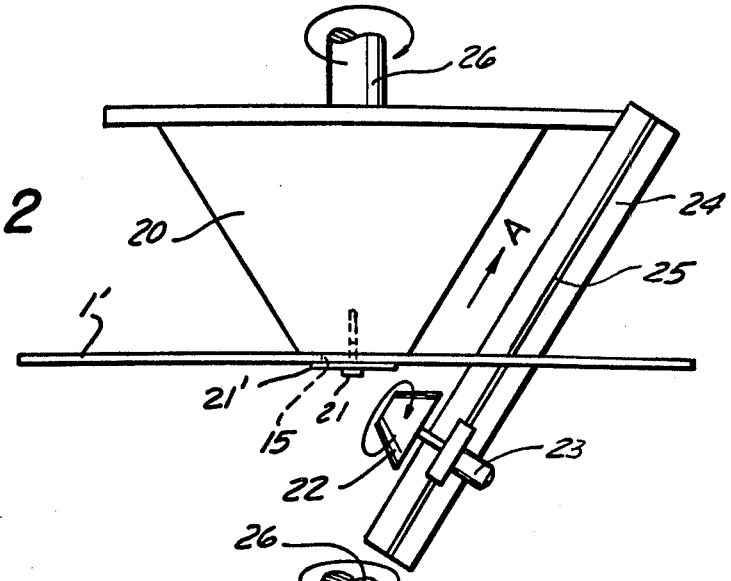
FIG. 2 is a partially broken, diagrammatic side view of the method of making the conically-shaped container at the start of the rolling operation according to the present invention.

The container 1 is comprised of one-piece metallic material, preferably super-refined stainless steel. The container is shaped so as to have a generally conical cross section in the following manner: FIG. 2 illustrates the initial phase of the shaping of the container 1. A metallic blank disc 1′, i.e., a stainless steel annular plate, has an original thickness which is provided with a central opening 15 which, after the shaping of the container 1 is completed, will correspond to the opening 15 that permits the container 1 to fit about the hub 4 of the rotor. The blank 1′ is pressed against the smaller base surface of a conically-shaped rotating tool 20 by means of the mounting element 21 and washer 21′ which overlies the opening 15. Next, the entire assembly comprising the blank 1′ and the tool 20 is rotated about the shaft 26.

An additional conically-shaped shaping tool 22 is provided adjacent the rotating assembly 20. The shaping tool 22 is mounted for rotation about its respective axis and is driven by the drive means 23. The shaping tool is also mounted for movement along an inclined guideway 25 provided on a support structure 24 in the direction of the arrow A.

Figure 3:
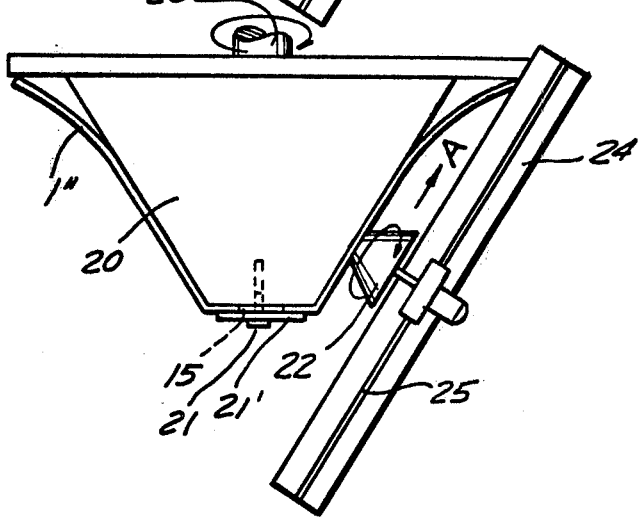
FIG. 3 is a partially broken, diagrammatic side view of the method according to the present invention during the rolling operation.
Figure 4:
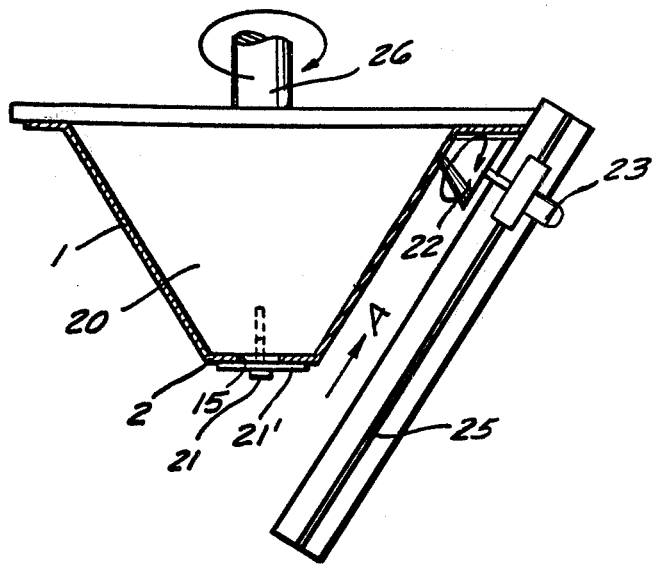
FIG. 4 is a partially broken, diagrammatic side view of the method of making the container at the end of the rolling operation according to the present invention.

In operation, the support 24 is positioned a predetermined distance away from the rotating assembly 20 so that as the shaping tool 22 travels along the guideway 25, the shaping tool 22 will engage the blank 1′ and press the latter against the conical exterior surface of the rotating assembly 20. FIG. 3 illustrates the shaping of the blank 1″ during the rolling operation in which the blank is stretched into a conical shape which results in a thinning of its circumferential wall.

Finally, the shaping tool 22 will stop its movement in the direction of the arrow A when it reaches the flange 27 which projects radially outwardly of the wider diameter base portion of the rotating assembly 20. The angle of inclination of the conical shaping tool 22 and the angle of the inclined guideway 25 are so selected that the finished container 1 will have an upper flange portion 3 which lies in a plane which is substantially parallel to the plane containing the base portion 2 of the container. Thus, the upper flange portion 3 and the base portion 2 have not been stretched so that they retain the original thickness of the blank 1′. For the sake of concreteness only and not intended to be self limiting in any way, if the original thickness of the blank 1′ is chosen to be 5 mm, then the base portion 2 and the upper flange portion 3 will likewise have a thickness of 5 mm, whereas the circumferential wall intermediate the base portion 2 and the upper flange portion 3 will be thinned to about 3.5 mm.

Thus, the finished container 1 is of one piece construction with integrally connected upper and lower portions. The lower portion which includes the base portion 2 fits within a conically-shaped recess which is bounded by the hub 4 and the outer annular lip portion 5, as shown in FIG. 1. The lip portion 5 extends generally outwardly in both the radial and axial directions so as to accommodate the lower portion of the container 1 and further has circumferentially extending grooves 13 spaced along its length. Adhesive means 14 is disposed intermediate the outer surface of the lower portion of the container 1 and the inner surface of the outer annular portion of the hub 4 which includes the lip portion 5. The adhesive 14 is a hardenable substance which cures over a period of time, for example, after several hours, and is adapted to secure metallic materials to each other.

A sieve 6 is situated over the entire inner surface of the container 1. The sieve 6 has an upper sieve flange 7 which overlies the upper container flange 3, a sieve base portion 8 which overlies the container base portion 2 and a circumferential sieve wall portion which overlies the circumferential wall of the container 1.

Ribs 16 are circumferentially distributed intermediate the flanges 3 and 7 and define radial passageways for an ingredient of a mixture to escape by centrifugal action. For example, in one purely exemplary application, if a sugar and water mixture is introduced into the interior of the container 1, then the sieve 6 will entrap the sugar particles, and the water, having a different density than the sugar, will be separated therefrom and ejected outwardly through the channels defined by the ribs 16.

The ribs 16 connect the flanges 3 and 7 together, and the screws 12 connect the base portions 8 and 2 together to the outer annular portion of the rotor. The screws 12 (only one of which is shown for the purpose of clarity) which are circumferentially distributed about the rotor perform other functions as well. Simultaneously, the adjusting screws 12 serve to true up the container 1 with the hub 4 in order to permit the rotating parts of the centrifuge to turn concentrically about the axis 11 without any wobble. Moreover, the screws 12 provide the necessary clamping pressure required in order to affirmatively urge the container against the rotor and thereby smear the adhesive 14 over the entire region of connection. Since the adhesive 14 generally requires some time to harden, the screws 12 can also be adjusted and readjusted with the aid of measuring instruments in order to allow for or take up any tolerances which would tend to cause the centrifuge to run out-of-true.

A second working sieve, which is finer than sieve 6, is not illustrated in the Figure for purposes of clarity. The working sieve is situated over the supporting sieve 6 and is secured, at its upper side, with the flange 7 and, at its lower side, by the clamping rings 9. The clamping ring 9 can either be connected with the hub 4 or with the feeding funnel 10.

In one preferred embodiment, the larger diameter of the container is 1100 mm, the smaller diameter of the container 1 is 400 mm, and the height of the container 1 is 560 mm. As noted above, the circumferential wall thickness is approximately 3.5 mm. These centrifuge dimensions have proven effective in commercial applications which subject the centrifuges to continuous loading. The rotation characteristic of the centrifuge is much improved over the known centrifuges because of the feature of truing up container 1. Even under continuous and intermittent feeding conditions and even under different mixture densities, the centrifuge arrangement is maintained substantially free of undesirable vibrations, especially during its rotation.

It will be understood that each of the elements described above, or two or more together, may also find a useful application in other types constructions differing from the type described above.

While the invention has been illustrated and described as embodied in a centrifuge arrangement and method of making a conical container therefor, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a centrifuge, a combination, comprising a hub mounted for rotation about an axis and having a central portion, a lip portion radially and outwardly spaced from said central portion having an inner conical face concentric with said axis and extending upwardly and outwardly, and a bottom portion connecting said central portion with said lip portion; a conically shaped container having a circumferential wall having a lower portion closely adjacent said conical surface and including a base portion integral with said circumferential wall; and adhesive means disposed intermediate said lower portion of said container and said inner conical face of said lip portion for securing said container with said hub so that the former rotates exactly coaxial with the latter without causing an imbalance during fast rotation of said centrifuge.

2. A combination as defined in claim 1, wherein said container further comprises an upper portion having an upper flange portion integral with said circumferential wall, said upper flange portion and said base portion having a greater thickness as compared with the thickness of said circumferential wall.

3. A combination as defined in claim 2, wherein said upper flange portion and said base portion have a thickness of 5 mm, and wherein said circumferential wall has a thickness of 3.5 mm.

4. A combination as defined in claim 1, wherein said container is symmetrically mounted about said axis, and wherein said circumferential wall progressively flares outwardly from said lower portion towards said upper portion.

5. A combination as defined in claim 1, wherein said container and said hub are constituted of metallic materials, and wherein said adhesive means is a hardenable substance adapted to bind said metallic materials together.

6. A combination as defined in claim 1, wherein said rotor further comprises a plurality of circumferentially extending grooves extending along said lip portion, successive ones of said grooves being respectively offset to a greater extent in the radial direction than preceding ones of said grooves.

7. A combination as defined in claim 6, wherein said grooves overlie said lower portion of said container, and wherein said adhesive means comprises a hardenable substance disposed between said lower portion and said lip portion and in said grooves.

8. In a centrifuge, a combination, as defined in claim 1, further comprising screw means tightening said base portion of said container to said bottom portion of said hub so that said adhesive means are uniformly distributed before hardening between said inner conical face of said lip portion of said hub and the outer surface of said lower portion of said container.

* * * * *